US006557623B2

(12) United States Patent
Shibata et al.

(10) Patent No.: US 6,557,623 B2
(45) Date of Patent: May 6, 2003

(54) PRODUCTION METHOD FOR CONTINUOUS CASTING CAST BILLET

(75) Inventors: Hiromitu Shibata, Chiba (JP); Yasuo Kishimoto, Chiba (JP); Shuji Takeuchi, Chiba (JP); Koji Yamaguchi, Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/959,858

(22) PCT Filed: Mar. 9, 2001

(86) PCT No.: PCT/JP01/01873

§ 371 (c)(1),
(2), (4) Date: Nov. 9, 2001

(87) PCT Pub. No.: WO01/66202

PCT Pub. Date: Sep. 13, 2001

(65) Prior Publication Data

US 2002/0157808 A1 Oct. 31, 2002

(30) Foreign Application Priority Data

Mar. 9, 2000 (JP) ..... 2000-064382

(51) Int. Cl.[7] ..... B22D 11/108; B22D 27/02
(52) U.S. Cl. ..... 164/461; 164/466; 164/473
(58) Field of Search ..... 164/461, 473, 164/459, 466, 502

(56) References Cited

FOREIGN PATENT DOCUMENTS

| | | |
|---|---|---|
| EP | 0 265 235 | 4/1988 |
| JP | 7-51801 | 2/1995 |
| JP | 8-257692 | 10/1996 |
| JP | 9-47852 | 2/1997 |

*Primary Examiner*—Kuang Y. Lin
(74) *Attorney, Agent, or Firm*—Young & Thompson

(57) ABSTRACT

Molten steel is poured using an immersion nozzle and a direct current magnetic field zone is applied to a cast slab over the entire width in the thickness direction thereof at a predetermined distance below the molten metal level in a continuously-casting mold. The immersion nozzle is provided with ejection holes located in at least upper and lower stages, at least one lower ejection hole is disposed such that these satisfy the following formula (1). The supply rate of molten steel from the upper ejection holes is set smaller than the rate consumed by solidification in an upper pool, and a particular solute element is added to the molten steel in the upper pool.

$$0<h<(1/2)\cdot w\cdot \tan\theta \quad (1)$$

where,

θ: downward angle of lower ejection hole(s) (°);

w: length of mold in width direction (m); and h: distance from center of lower ejection hole to center of height of magnetic pole (m).

4 Claims, 9 Drawing Sheets

PRODUCTION METHOD FOR CONTINUOUS CASTING CAST BILLET

TECHNICAL FIELD

The present invention relates to a method of manufacturing a continuously-cast cast piece having an inclining composition in which the concentration of a particular solute element is higher in the surface layer of the cast piece than the interior thereof.

BACKGROUND ART

Hitherto, various methods of manufacturing a cast piece the component of which is different between the surface layer portion and the interior thereof by continuous casting are proposed.

For example, Japanese Examined Patent Application Publication No. 3-20295 discloses a method of manufacturing a multi-layer cast piece by applying direct current magnetic fluxes to the cast piece in the overall length thereof in a direction perpendicular to a casting direction from a position, which is located below the molten metal level in a continuously-casting mold and is spaced apart therefrom a predetermined distance; and supplying different metal to the upper side and the lower side of a static magnetic field zone that is formed by the direct current magnetic fluxes and acts as a boundary.

Further, Japanese Unexamined Patent Application Publication No. 7-51801 discloses a method of manufacturing a multi-layer steel sheet by pouring molten steel into a continuously-casting mold together with a gas in a vertical direction, reducing the upward flow speed of the molten steel by applying direct current magnetic fluxes to the molten steel in the mold in the overall length thereof from a position above a molten steel pouring position; adding an element different from the components of the molten steel to the molten steel located above the position from which the direct current magnetic field is applied; making the molten steel located at the upper portion to alloy molten steel by the stirring caused by the floating of the poured gas; and forming a surface layer composed of the alloy steel on the surface of the steel.

Furthermore, Japanese Unexamined Patent Application Publication No. 8-257692 discloses a method of manufacturing a cast piece having a uniform concentration of alloy element in the surface layer thereof by pouring molten steel having a predetermined composition, while forming a brake zone by applying a direct current magnetic field to a mold in the overall width thereof from a position a predetermined distance below a meniscus, using an immersion nozzle having the ejection holes of a nozzle above and blow the brake zone; and further continuously feeding alloy elements, which makes use of wires, to a molten steel pool above the brake zone and stirring the alloy element by the flow of the poured molten steel.

However, since the method disclosed in the Japanese Examined Patent Application Publication No. 3-20295 includes a very complicated process for separately refining the molten steel used in the surface layer of the cast piece and the molten steel used in the interior thereof, the method is liable to cause malfunction in production. Moreover, it is difficult to manufacture the cast piece stably in the method because it is necessary to perform very difficult control for independently supplying molten steel from respective tundishes in quantities according to the solidifying speeds thereof above and below the magnetic field zone. As a result, there is a problem that the yield of a product decreases.

As to this point, such strict control as described above is not required to the manufacturing method disclosed in Japanese Unexamined Patent Application Publication No. 7-51801. This is because that molten steel supplied from a tundish is one kind and the molten steel is supplied so as to maintain the molten metal in the mold to a predetermined level only below the magnetic field zone. Accordingly, the quantity of steel that is insufficient to a quantity of molten steel to be solidified above the magnetic field zone naturally flows from the lower portion of the magnetic field zone, and thus the strict control as described above is not necessary.

In this case, however, the molten steel slowly flows from the lower portion of the magnetic field zone to the upper zone thereof by the influence of the direct current magnetic filed. As a result, a problem arises in that an extreme difference of concentration between a portion to which a solute element is added and a portion apart from the above portion cannot be eliminated only by the stirring effect of bubbles.

Further, in the manufacturing method disclosed in Japanese Unexamined Patent Application Publication No. 8-257692, the same molten steel is supplied to upper and lower pools from the single nozzle having the ejection holes above and below the magnetic field zone. Thus, the method does not require a complicated process for separately preparing two types of molten steel.

In the method, however, the ratio of the quantities of molten steel to be supplied to the upper pool and the lower pool is controlled by adjusting the ratio of the inside diameters of the upper and lower ejection holes. Accordingly, when the ratio of the molten steel supplied to the lower pool is reduced even slightly, the boundary of the upper and lower molten steels having a different composition is offset from the magnetic field zone. Thus, the method is disadvantageous in that the alloy component in the upper pool drains to the lower pool and the yield of a product greatly decreases.

Conversely, the ratio of quantity of flow of molten steel to the upper pool decreases or a casting speed cannot help being reduced due to trouble, and the like in operation, molten steel containing a less quantity of alloy component flows in from the lower pool to the upper pool. At this time, since the molten steel that flows from the lower portion to the upper portion rises along both the ends of the mold in a width direction due to the influence of the stream of the molten steel from the lower ejection hole, a problem arises in that the alloy component decreases at both the ends of a cast piece and thus, the yield of a product greatly decreases, too.

An object of the present invention, which advantageously solves the above problems, is to propose an advantageous method of manufacturing a continuously-cast cast piece which not only permits the supply of molten steel to upper and lower pools to be easily controlled but also can simply and appropriately adjust the concentration of a solute element in the surface layer of the cast piece.

DISCLOSURE OF INVENTION

That is, the gist and the composition of the present invention is as shown below.

1. A method of manufacturing a continuously-cast cast piece by continuously casting molten steel in such a manner that a direct current magnetic field zone is applied to the cast piece over the entire width thereof in a direction across the thickness thereof at a position a predetermined distance below the molten metal level to casting direction in a continuously-casting mold and that the molten steel is poured using an immersion nozzle into a molten steel pool in or above the direct current magnetic field zone, the method comprising the steps of providing the immersion nozzle with ejection holes in at least upper and lower two stages; disposing a lower ejection hole(s) such that it satisfies the following formula (1); setting the supply speed Q' of the molten steel supplied from upper ejection holes smaller than the speed Q consumed by solidification in the molten steel pool above the center of height of the direct current magnetic field zone; and adding a particular solute element to the molten steel in or above the direct current magnetic field zone, thereby adjusting the concentration of the solute element in the surface layer portion of the cast piece by increasing the concentration of the solute element as to the molten steel in the upper pool.

$$0<h<(1/2)\cdot w\cdot\tan\theta \quad (1)$$

where,

θ: downward angle of lower ejection hole(s) (°);

w: length of mold in width direction (m); and h: distance from center of lower ejection hole to center of height of magnetic pole (m)

2. A method of manufacturing a continuously-cast cast piece according to above 1, wherein an immersion nozzle, which is designed such that the upper ejection holes satisfy the following formula (2), is used.

$$h'>(1/2)\cdot w\cdot\tan\theta' \quad (2)$$

where,

θ': downward angle of upper ejection holes (°);

w: length of mold in width direction (m); and h': distance from center of upper ejection hole to center of height of magnetic pole (m)

3. A method of manufacturing a continuously-cast cast piece according to above 1 or 2, wherein an immersion nozzle, which is designed such that the upper ejection holes and the lower ejection hole(s) satisfy the following formulas (3) and (4), is used.

$$0<h\leqq 1.5V\cdot\sin\theta \quad (3)$$

$$d\leqq 0.5 \quad (4)$$

where, h: distance from center of lower ejection hole to center of height of magnetic pole (m);

V: average flow speed (m/s) of flow ejected from lower ejection hole(s) (m/s);

θ: downward angle of lower ejection hole(s) (°); and d: distance from center of upper ejection hole to center of lower ejection hole (m)

4. A method of manufacturing a continuously-cast cast piece according to above 1, 2 or 3, wherein an immersion nozzle, which is designed such that the supply speed of the molten steel supplied from the upper ejection holes satisfies the following formula (5), is used.

$$0.3\cdot Q\leqq Q'\leqq 0.9\cdot Q \quad (5)$$

where,

Q': supply rate of molten steel supplied from upper ejection holes (ton/min)

Q: consumption rate of molten steel which solidifies in molten steel pool above center of height of magnetic pole (ton/min)

Reference Numerals

1 mold

2 immersion nozzle

3 magnetic pole

Figure 1:
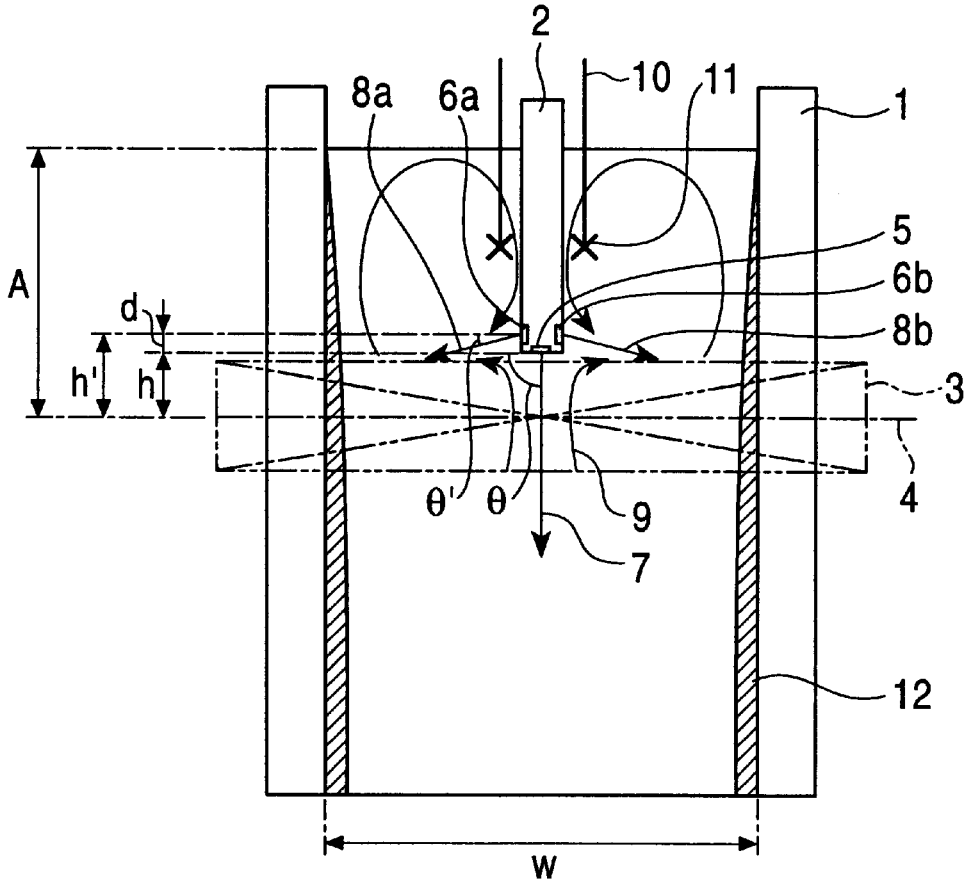
FIG. 1 is a schematic view showing an example of a manner of pouring molten steel according to the present invention (when a lower ejection hole is arranged as a single hole facing vertically downward).

4 center of height of magnetic pole
5 lower ejection hole of immersion nozzle
6 upper ejection hole of immersion nozzle
7 stream from lower ejection hole
8 stream from upper ejection hole
9 backward flow from lower pool of direct current magnetic field zone to upper pool thereof
10 solute element (wire)
11 position in which solute element is added
12 solidified shell
13 induced current
14 direct current magnetic field (direction of magnetic field)
15 electromagnetic force
16 stream portion
17 region in mold where condensation of solute element appears
18 region where degree of condensation of solute element is low
19 region where no condensation of solute element appears in mold
20 surface layer of cast piece (portion where condensation of solute element appears)
21 solute element concentration transition layer of cast piece (portion where degree of condensation of solute element is low)
22 inner layer of cast piece (no condensation of solute element appears)

BEST MODE FOR CARRYING OUT THE INVENTION

The present invention will be specifically described below according to the drawings.

FIG. 1 schematically shows an example of a manner of pouring molten steel according to the present invention. In the example, a nozzle having a single lower ejection hole and two upper ejection holes is employed as an immersion nozzle. Molten steel supplied from the lower ejection hole flows in an approximately vertical direction.

In the figure, numeral 1 denotes a mold, numeral 2 denotes an immersion nozzle, and numeral 3 denotes a magnetic pole. A direct current magnetic zone can be applied to a cast slab in the overall width thereof in its thickness direction by the magnetic pole 3.

Numeral 4 denotes the center of height of the magnetic pole. Further, numeral 5 denotes the lower ejection hole of the immersion nozzle 2, numerals 6*a* and 6*b* denote the upper ejection holes of the immersion nozzle 2, respectively, numeral 7 denotes a stream from the lower ejection hole 5, numerals 8*a* and 8*b* denote streams from the upper ejection holes 6*a* and 6*b*, numerals 8*a* and 8*b* denote the streams from the upper ejection holes 6*a* and 6*b*, and numeral 9 denotes a backward flow from the lower pool of the direct current magnetic field zone to the upper pool thereof. Numeral 10 denotes a solute element (wires), numeral 11 denotes positions in which the solute element 10 is added, and numeral 12 denotes a solidified shell.

Note that, in the figure, "w" denotes the width of the mold, "θ" and "θ'" denote the angles of the lower and upper ejection holes 5 and 6 of the immersion nozzle 2, respectively (downward angles when a horizontal direction is denoted by O), "h" denotes the distance from the center of the lower ejection hole to the center of height of the magnetic pole, "h'" denotes the distance from the center of the upper ejection holes to the center of height of the magnetic pole, "d" denotes the distance from the center of the upper ejection holes to the center of the lower ejection hole, and "A" denotes the distance from the molten metal level in the mold to the center of height of the magnetic pole.

In the arrangement shown in FIG. 1, the stream 7 of molten steel supplied from the lower ejection hole 5 of the immersion nozzle 2 flows into the lower pool of the magnetic field zone once. However, the quantity, which corresponds to the insufficient quantity of the molten steel in the upper pool, of the molten steel having flowed into the lower pool once naturally flows backward into the upper pool. This is because that the supply speed Q' of the molten steel that is supplied from the upper ejection holes 6 to the upper pool is smaller than the consumption rate Q of the molten steel that is solidified and consumed in the upper pool.

Accordingly, in the present invention, no problem arises as to the control of the supply speed of molten steel similarly to the method described in Japanese Unexamined Patent Application Publication No. 7-51801.

Figure 2:
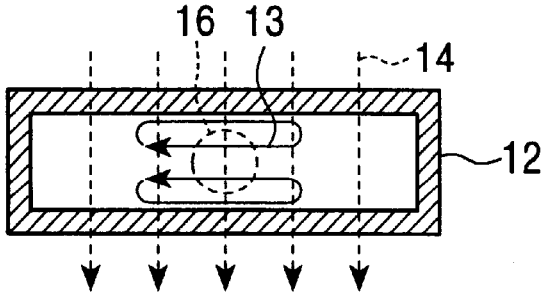
FIG. 2 is a view explaining an induced current generated around the stream of molten steel from a nozzle.
Figure 3:
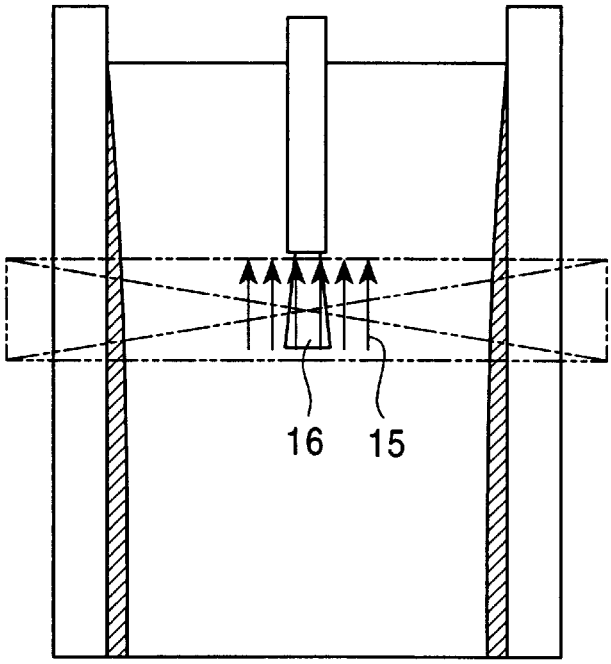
FIG. 3 is a view explaining electromagnetic force generated around the stream of the molten steel from the nozzle in the present invention.

Further, in the present invention, since the stream 7 of the molten steel supplied from the lower ejection hole 5 of the immersion nozzle 2 travels across the direct current magnetic field zone, an induced current electric current 13 as shown in FIG. 2 is generated around the stream 7. As a result, electromagnetic force 15 as shown in FIG. 3 is generated by the interaction between the induced current 13 and a direct current magnetic field 14. As described above, force having a direction opposite to the direction of the stream 7, that is, so-called electromagnetic brake force is generated in a stream portion 16. However, since the induced current 13 is inevitably generated also on both the sides of the stream portion 16, similar force is generated on both the sides so that a backward flow is liable to generate on both the sides of the stream portion 16.

Figure 4:
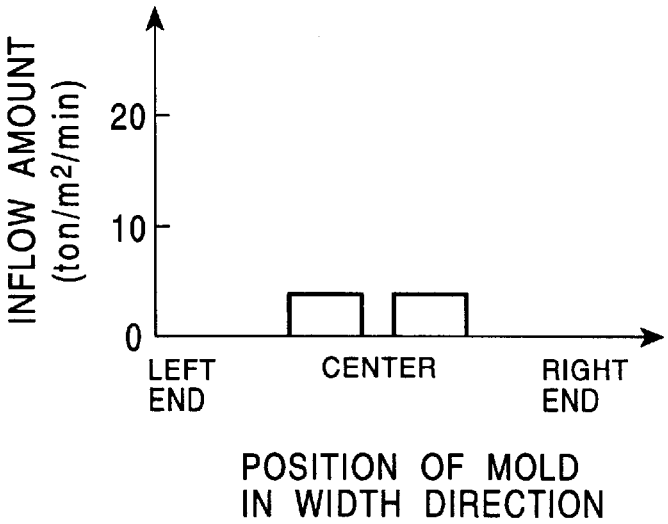
FIG. 4 is a chart showing the distribution of molten steel that flows from the lower pool of a magnetic field zone to the upper pool thereof in the present invention.

As a result, the flow of the molten steel from the lower pool of the magnetic field zone to the upper pool thereof occurs only in the portions on both the sides of the stream portion 16 as shown in FIG. 4.

As described above, the flow of the molten steel from the lower pool to the upper pool occurs in the particular region limited to both the sides of the stream portion 16 from the lower ejection hole 5 and gathers to both the sides of the nozzle. However, since the upper ejection holes 6 exist there, the molten steel having flowed from the lower pool is drawn into streams 8 from the upper ejection holes 6 and is uniformly blended with additive alloy while being forcibly flowed in the directions of both the ends of the mold together with the molten steel supplied from the upper ejection holes 6.

Figure 5:
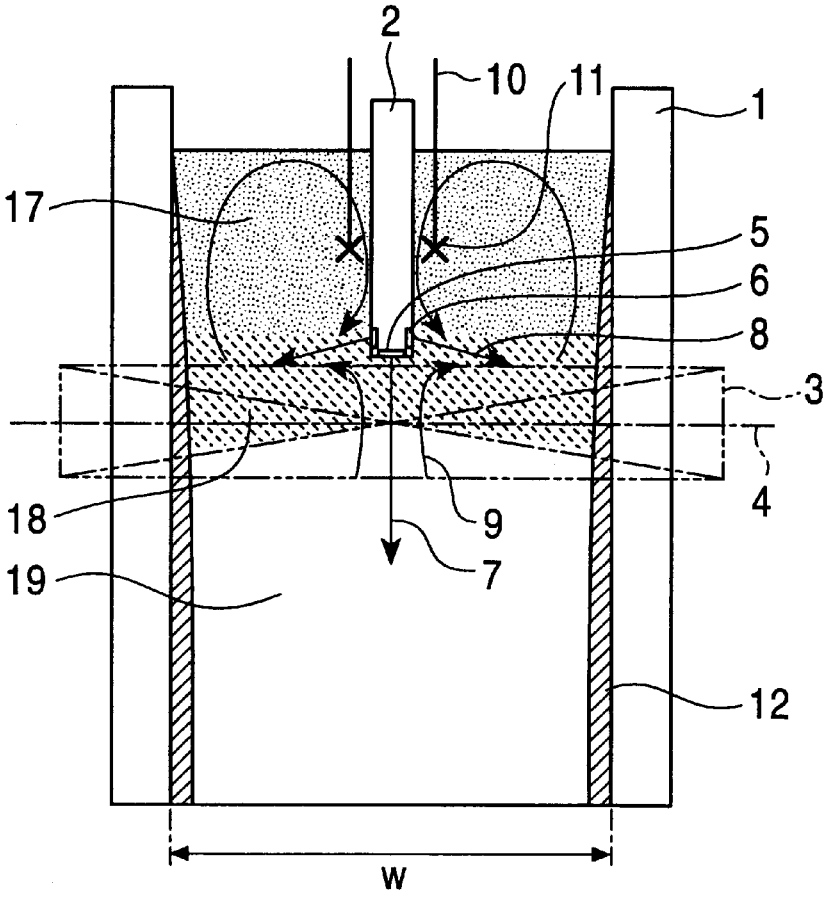
FIG. 5 is a view showing the distribution of concentration of a solute element in a mold in the present invention.
Figure 6:
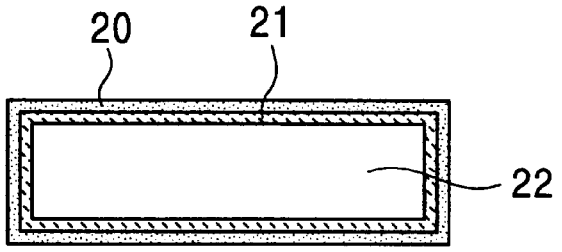
FIG. 6 is a view showing the distribution of a solute element in the cross section, which is vertical to a casting direction, of a cast piece in the present invention.

Accordingly, the concentration of the solute element according to the present invention is distributed in the mold as shown in FIG. 5, and a resultant cast slab is arranged as shown in FIG. 6.

In FIG. 5, numeral 17 denotes a region in the mold where the condensation of the solute element appears, numeral 18 denotes a region where a degree of condensation of the solute element is low, and numeral 19 denotes a region where no condensation of the solute element appears. Further, in FIG. 6, numeral 20 denotes a portion, where the condensation of the solute element appears, of the surface layer of the cast piece, numeral 21 denotes a solute element concentration transition layer, where a degree of condensation of the solute element is low, of the cast slab, and numeral 22 denotes an inner layer, where no condensation of the solute element appears, of the cast slab.

As described above, in the present invention, the portion where the molten steel flows from the lower pool to the upper pool is limited to the particular region, that is, both the sides of the stream portion, and the molten steel having flowed joins the stream from the upper ejection holes in the vicinity of the nozzle. Thus, even if the nonmetal inclusions in the molten steel deposit on the upper ejection holes and the rate of quantity of flow from the upper ejection holes decreases, the region where the concentration of the solute is low is not changed with only an increase in the quantity of flow of the molten steel from the lower pool. Thus, the distribution of concentration of the solute element does not change in the upper pool.

In contrast, even if the rate of quantity of flow from the lower ejection hole(s) decreases, the distribution of concentration of the solute element is not also changed in the upper pool with only the quantity of flow thereof reduced. This is because there is exists the molten steel that flows from the lower portion from the beginning.

Further, in the present invention, since the molten steel supplied to the lower pool is supplied from above the magnetic field zone, the speed thereof is reduced when it passes through the magnetic field zone, whereby the entrainment of nonmetal inclusion in a lower direction, which is a cause of an internal defect, is reduced and internal quality is improved.

Figure 7:
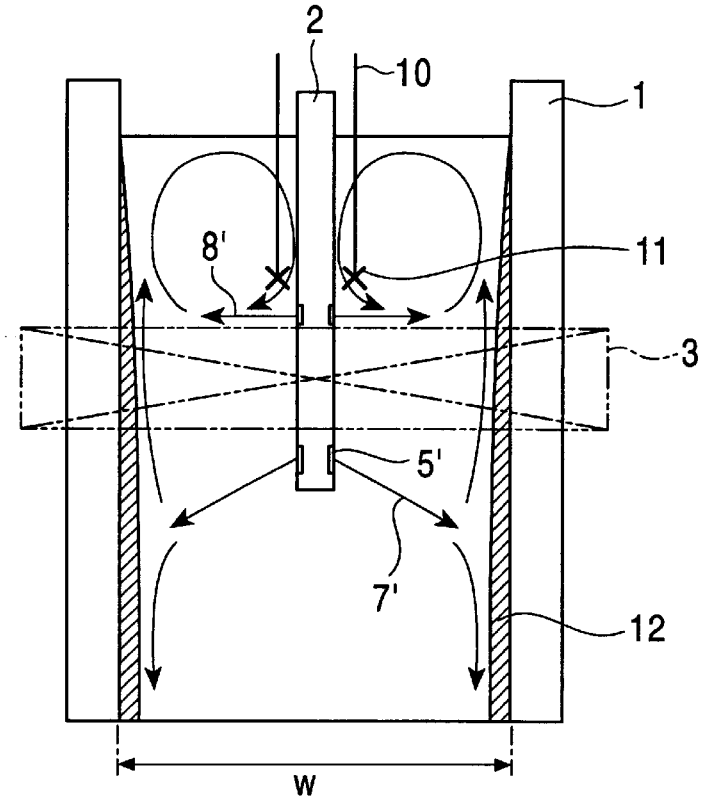
FIG. 7 is a schematic view showing an example of a manner of pouring molten steel according to a comparative example (when a quantity of flow of molten steel from upper ejection holes decreases).

For comparison, the flow of molten steel was examined in a case in which the molten steel was supplied through the ejection holes, which were disposed in the upper and lower pools of a magnetic field zone, of an immersion nozzle as in the method described in Japanese Unexamined Patent Application Publication No. 8-257692 and in which the supply ratio of molten steel to the lower pool was increased. FIG. 7 shows a result of the examination.

Figure 8:
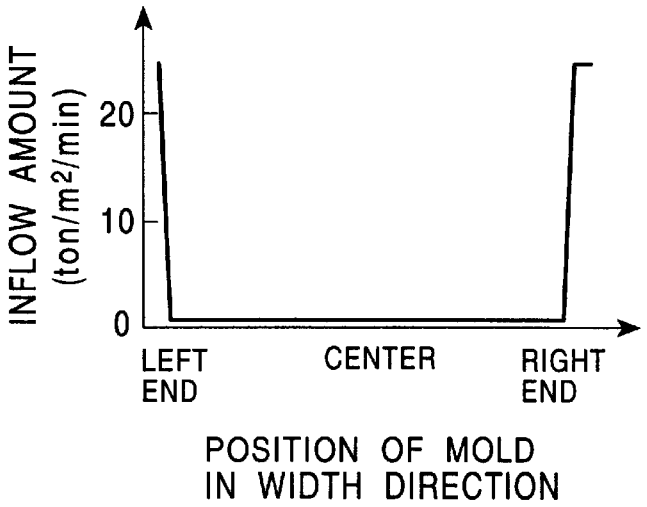
FIG. 8 is a chart showing the distribution of molten steel that flows from the lower pool of a magnetic field zone to the upper pool thereof in the comparative example.
Figure 9:
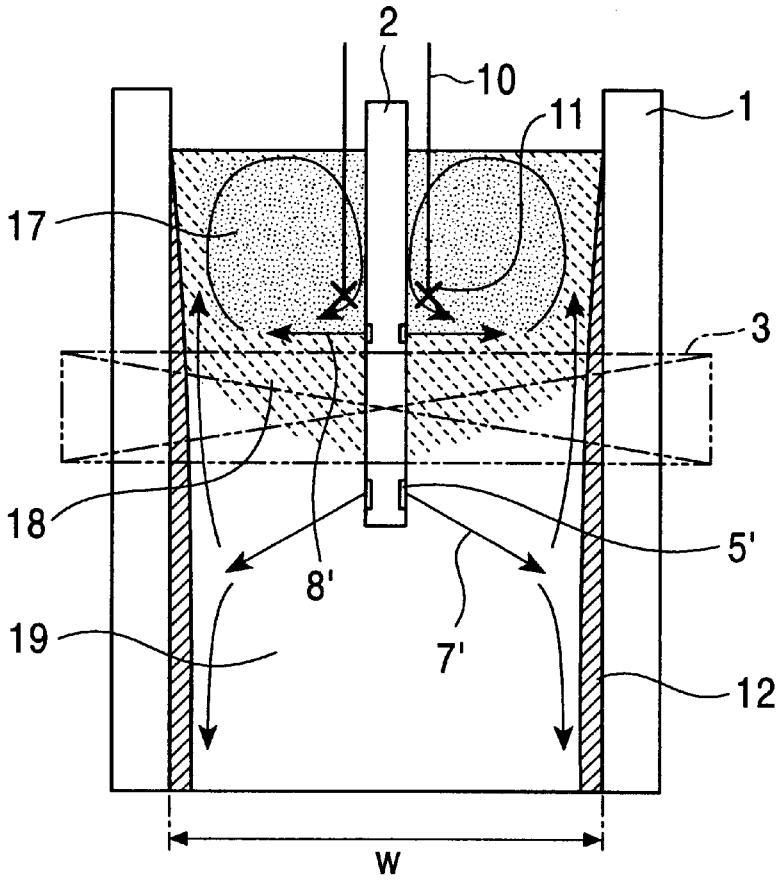
FIG. 9 is a view showing the distribution of concentration of a solute element in a mold in the comparative example.
Figure 10:
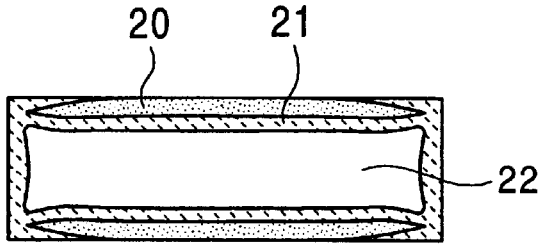
FIG. 10 is a view showing the distribution of concentration of a solute element in the cross section, which is vertical to a casting direction, of a cast piece in the comparative example.

As shown in the figure, the position of flow from a lower portion is concentrated to both the ends of a mold by the influence the strong streams 7' from lower ejection holes 5' in the method (refer to FIG. 8). Thus, in the distribution of concentration of the solute element in the mold, regions where a degree of concentration of the solute element is low appears on both the ends of the mold as shown in FIG. 9. As a result, surface layer portions where the concentration of alloy is low are created on the short side surface layer portions of a cast slab as shown in FIG. 10. On the contrary, when a molten steel supply ratio to an upper portion increases, the solute in the upper pool flows to the lower pool and the concentration of the solute is decreased in a surface layer.

Further, the above problem can be solved when the quantities of flow from the ejection holes in the upper portion and the lower portion are accurately controlled to avoid the problem. However, it is actually very difficult to accurately control the quantities of flow from the nozzle.

This is because that the quantity of flow from the nozzle varies to a certain extent due to clogging of the nozzle, an unbalanced flow in the mold, and the like.

Therefore, it is substantially very difficult to control the concentration of the solute in the surface layer by the method of the comparative example.

As described above, it is necessary in the present invention to appropriately install the lower ejection hole(s) so as to permit a backward flow to be generated easily around the stream of the molten steel supplied to the lower pool. As a result of various examinations about this point, it has been found that the following relationship must be satisfied as to the positions of the upper and lower ejection holes, ejection angles, and the position to which a magnetic field is applied.

First, as to the lower ejection hole(s), it is necessary to satisfy the following formula (1), and it is preferable to satisfy the relationship of the following formula (3).

$$0<h<(1/2)\cdot w\cdot\tan\theta \quad (1)$$

$$0<h\leqq 1.5V\cdot\sin\theta \quad (3)$$

where,

θ: downward angle of lower ejection hole(s) (°);

w: length of mold in width direction (m);

h: distance from center of lower ejection hole to center of height of magnetic pole (m); and V: average flow speed of flow ejected from lower ejection hole(s) (m/s)

Here, a reason why the formula (1) is necessary is that unless this condition is satisfied, a stream collides against the wall surfaces at both ends before it sufficiently passes through the magnetic field zone, and a backward flow from the lower pool cannot be sufficiently generated.

Further, a reason why the formula (3) is preferable is that since a stream mostly damps in inverse proportion to the distance from an ejection hole, when the lower ejection hole is far from the magnetic pole, the stream diffuses before it passes through the magnetic field zone. Further, when the ejection hole is installed below the center of the magnetic pole, the backward flow having been generated is damped by a magnetic field above the center of the magnetic field. Thus, a backward flow cannot also be sufficiently generated.

Here, V is obtained by dividing the quantity of molten steel ($m^3/s$) flowing from the lower ejection hole(s) by the cross sectional area of the lower ejection rate.

Note that the shape of the ejection hole must be designed so that the stream does not come into contact with the solidifying surfaces of the long sides in the upper pool.

In contrast, since it is necessary to prevent the molten steel flow from the upper ejection holes from flowing to the lower pool, it is preferable to satisfy the following formula (2). Further, it is preferable to satisfy the following formula (4) to cause the molten steel that flows from the lower pool to be sufficiently drawn into the molten steel flow from the upper ejection holes so that the molten steel from the lower pool does not reach the solidifying surfaces in the upper pool.

$$h'>(1/2)\cdot w\cdot\tan\theta \quad (2)$$

$$d\leqq 0.5 \quad (4)$$

where,

θ': downward angle of upper ejection holes (°);

w: length of mold in width direction (m)

h': distance from center of upper ejection holes to center of height of magnetic pole (m)

d: distance from center of upper ejection hole to center of lower ejection hole (m)

Further, the supply rate of the molten steel from the upper ejection holes must be set smaller than the rate at which the molten steel is consumed by being solidified in the upper pool in consideration of the variation of the ratio of the molten steels supplied from the upper ejection hole and the lower ejection hole. However, when the supply rate of the molten steel from the upper ejection holes is less than 0.3 times the consumption rate of the molten steel in the upper pool, there is a case in which a speed of the stream, which is sufficient to draw in the molten steel supplied from the lower pool and the added solute element and to blend them together, cannot be obtained even under the conditions in which the above formula (4) is satisfied.

Accordingly, it is preferable to satisfy the relationship of the following formula (5) as to the supply speed Q' (ton/min)

of the molten steel to be supplied from the upper ejection holes and the consumption rate Q (ton/min) of the molten steel that is solidified in the upper molten steel pool.

$$0.3 \cdot Q \leq Q' \leq 0.9 \cdot Q \quad (5)$$

Figure 11:
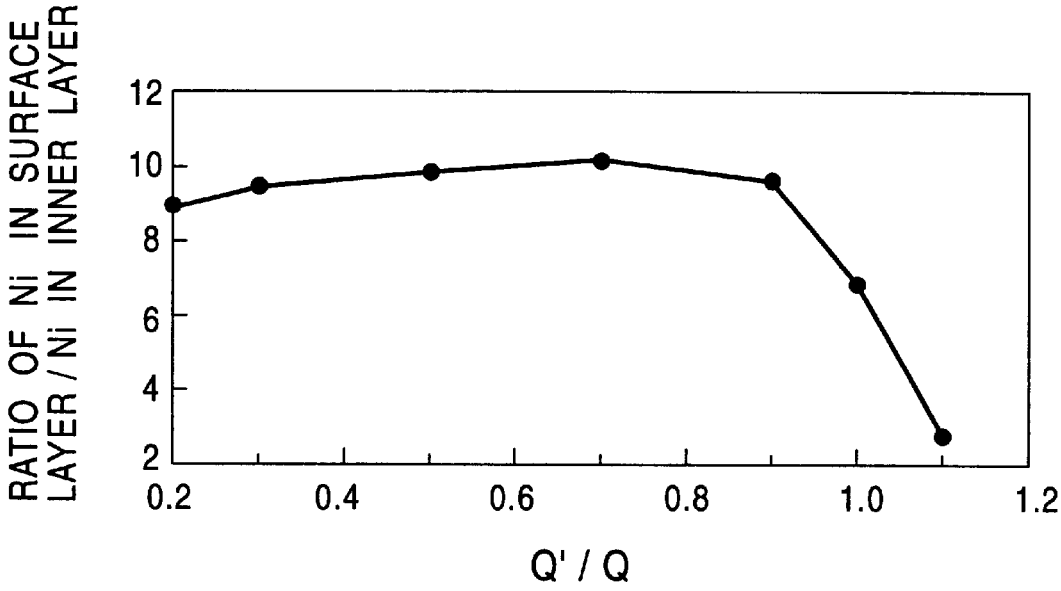
FIG. 11 is a chart showing the ratio of the Ni concentration in the surface layer of a cast piece to the Ni concentration in the inner layer thereof when operation is performed by changing Q'/Q according to the present invention.

FIG. 11 shows Q'/Q and the ratio of surface layer Ni to inner surface Ni. This is an example in which the ratio of the surface layer Ni to the inner surface Ni is controlled to 10. Actually, however, when Q/Q=0.9 is exceeded, the ratio of the surface layer Ni to the inner surface Ni decreases. This is because that when Q'/Q exceeds 0.9, a flow is caused from an upper pool layer to a lower pool layer because the supply ratio of the molten steel from the upper and lower ejection holes varies as described above.

Figure 12:
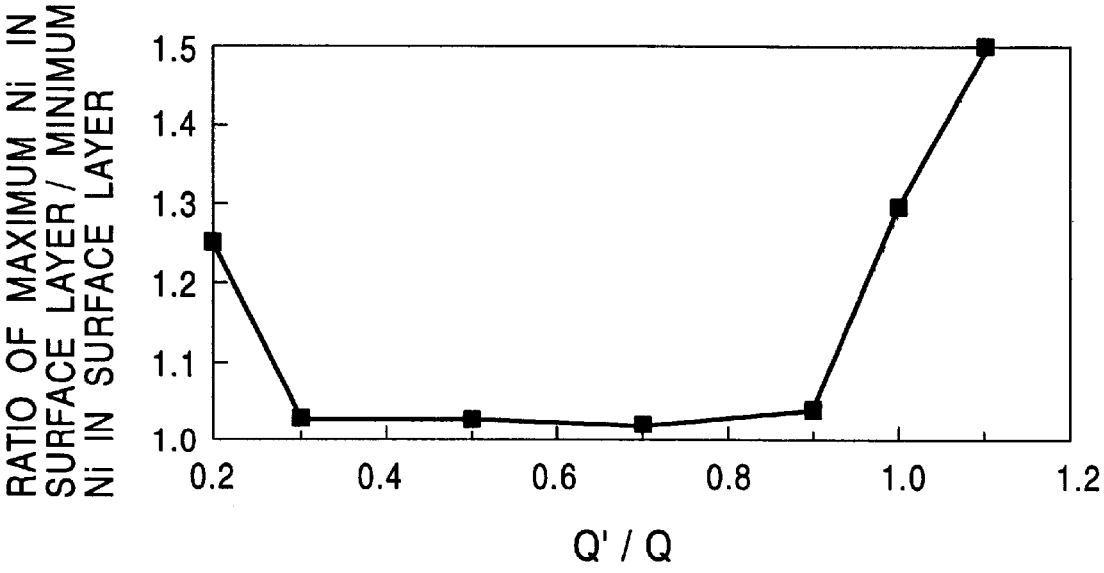
FIG. 12 is a chart showing the dispersion of the Ni concentration in the surface layer of the cast piece to the Ni concentration in the inner layer thereof when operation is performed by changing Q'/Q according to the present invention.
Figure 13:
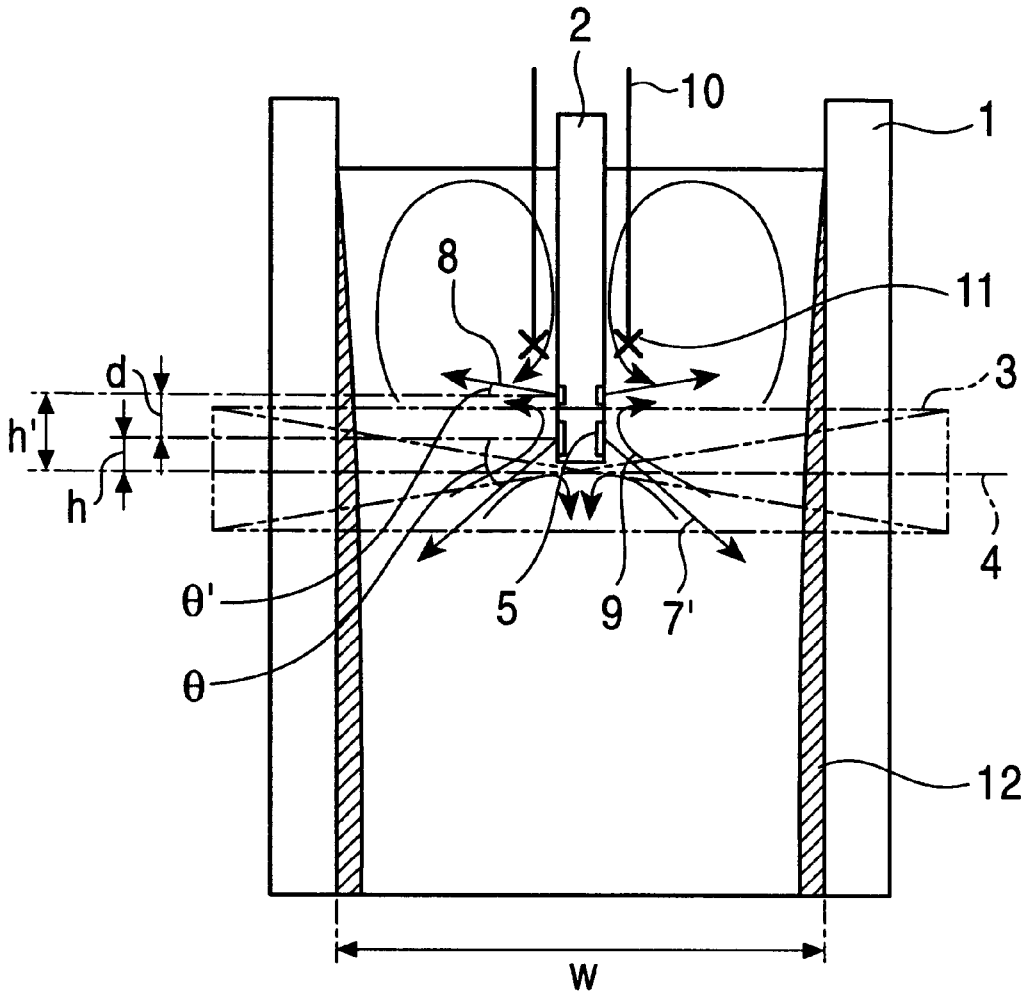
FIG. 13 is a schematic view showing another example of the manner of pouring molten steel according to the present invention (when a lower ejection hole is arranged as a two hole type).

FIG. 12 shows Q'/Q and the ratio of maximum Ni to minimum Ni which is determined from samples taken from a plurality of positions on a surface layer portion. The ratio which is as nearer to 1 as possible shows that the concentration of the solute in the surface layer less disperses. However, it has been found that when Q'/Q exceeds 0.9 or when Q'/Q is less than 0.3, the dispersion will greatly increase.

A reason why a difference of concentration arises when Q'/Q exceeds 0.9 is that a local flow is caused due to the flow of the molten steel from the upper pool layer to the lower pool layer.

Further, this is because that when Q'/Q is less than 0.3, a speed of the stream, which is sufficient to circulate and blend the molten steel in the upper pool layer, cannot be obtained.

Then, it has been found that when operation is performed under the conditions for satisfying especially the above formulas (1) to (5), a uniform cast slab can be manufactured with a high yield without decreasing the concentration of the solute element in the surface layer thereof.

Note that while description has been made with reference only to the figure, in which the single lower ejection hole facing downward at 90° is employed, in the above example, important matter in the present invention is to locally generate a flow portion where the molten steel flows from the lower pool to the upper pool. Accordingly, even in a case of two lower ejection holes as used in ordinary continuous casting, it is possible to create a desired local flowing portion when the above formula (1) is satisfied as shown in FIG. 11.

Further, it is preferable to dispose the lower ejection hole above the center of the magnetic pole in order to increase the effect of forming the local flowing portion and the damping effect of the stream from the lower ejection hole.

When the strength of the applied magnetic field is too small, there is a possibility that the molten steel in the upper pool is blended with the molten steel in the lower pool because the braking effect performed by the magnetic field is weakened. In contract, when the strength is too large, the flow of the molten steel to the upper pool becomes too strong and the molten steel is supplied to the upper pool in a quantity larger than necessary. As a result, there is a possibility that the molten steel in the upper pool flows out at a portion apart from the flow portion. Accordingly, it is important to provide the applied magnetic field with a proper strength which does cause the blend of the molten steel in the upper pool with that in the lower pool and which does not disturb the uniform dissolution of the alloy element. Thus, it is preferable that the applied magnetic field be ordinarily set to about 0.1 to 0.5 T.

Further, when the quantity of flow of Ar gas poured into the nozzle is too large in the same way, the flow of the Ar gas into the upper pool is too strong, by which a pinhole defect carved by the bubbles is liable to be caused. Thus, it is preferable to set the quantity of flow of the Ar gas to 20 l/min or less.

Further, when the width (in the height direction) of the direct current magnetic field zone to be applied is too small, a brake effect is not sufficient, whereas when the width is too large, the capacity of a power supply and a coil size, which are necessary to generate the magnetic field, increase, whereby an equipment cost is increased. Therefore, it is preferable to set the width to 0.1 to 0.5 m in the width of the magnetic pole in a height direction.

EXAMPLES

Continuous cast slabs were manufactured under the following conditions (examples to which the present invention is applied) using the continuously casting mold shown in FIG. 1.

Inside dimension of mold
- long side w=0.4 m, short side: 0.11 m

Example 1

- Direct current magnetic field application position (distance from molten metal level in mold to center of height of magnetic pole)
  - A: 0.347 m
- Strength of applied magnetic field: 0.3 T
- Height of magnetic field: 0.15 m
- Immersion nozzle
  - Upper ejection hole: 2 holes, size of hole 10*10 mm
    - ejection angle θ=0° (horizontal)
  - Lower ejection hole: single hole, size of hole 28 mm dia (circle)
    - ejection angle θ=90° (vertically downward)
- Immersed depth of lower hole (from molten metal level in mold to lower end of lower ejection hole) 0.34 m
- Immersed depth of upper holes (from molten metal level in mold to center of upper ejection hole) 0.177 m
- Inner diameter of immersion nozzle 0.040 m
- Distance from lower ejection hole to center of height of magnetic pole h: 0.007 m
- Distance from upper ejection hole to center of height of magnetic pole h': 0.170 m
- Casting speed: 1.6 m/min Throughput of cast: 0.49 t/min
- Supply rate of molten steel from upper holes Q':
  - Q'=0.76 Q (0.76 times consumption rate of molten steel that solidifies at a position above center of height of magnetic pole)
- Solute element (pure Ni wires)
  - Feed positions of pure Ni wires (horizontal distances from upper ejection holes in both end directions): 0.1 m
  - Melting positions of pure Ni wires (distances to upper ejection holes in height direction): 0.12 m
  - Wire feed speed: 3.5 kg/min Note that it has been found that the thickness of growth d (m) of a solidified shell in the above casting machine is given by the following formula (6).

$$d = 0.022 \times (A/Vc)^{0.5} \quad (6)$$

where, A shows distance (m) from molten metal level to center of height of magnetic pole, and Vc shows a casting speed (m/min).

Therefore, it can be found from the above formula (6) that the thickness of the solidified shell at the boundary section between the upper and lower pools is about 10.2 mm.

As a result, Q=0.112 t/min is established. In contrast, since Q' is 17.5% of an overall throughput from a water model and the like, Q'=0.0853 t/min is established. Therefore, Q'=0.76 Q.

Example 2

Direct current magnetic field application position (distance from molten metal level in mold to center of height of magnetic pole)
A: 0.347 m Strength of applied magnetic field: 0.3 T Immersion nozzle
Upper ejection hole: 2 holes, size of hole 10*10 mm
ejection angle θ=0° (horizontal)
Lower ejection hole: single hole, size of hole 28 mm dia (circle)
ejection angle θ=90° (vertically downward)

Immersed depth of lower hole (from molten metal level in mold to lower end of lower ejection hole) 0.290 m Immersed depth of upper hole (from molten metal level in mold to center of upper ejection hole) 0.127 m Inner diameter of immersion nozzle 0.040 m (40 mm)

Distance from lower ejection hole to center of height of magnetic pole h: 0.057 m Distance from upper ejection hole to center of height of magnetic pole h': 0.220 m Casting speed: 1.2 m/min Throughput of cast: 0.37 t/min Supply rate of molten steel from upper holes Q':
Q'=0.63 Q (0.63 times consumption rate of molten steel that solidifies at a position above the center of height of magnetic pole)

Solute element (pure Ni wires)
Feed positions of pure Ni wires (horizontal distances from upper ejection holes in both end directions): 0.1 m
Melting positions of pure Ni wires (distances to upper ejection holes in height direction): 0.05 m
Wire feed rate: 3.6 kg/min Note that it can be found from the above formula (6) that the thickness of growth (m) of the solidified shell is about 11.8 mm at the boundary section between the upper and lower pools in the above casting machine.

As a result, Q=0.0965 t/min. In contrast, since Q' is 16.5% of an overall throughput from a water model and the like, Q'=0.0611 t/min. Therefore, Q'=0.63 Q.

Further, for comparison, continuously-cast cast slabs were also manufactured under conditions in which the lower ejection hole was installed below the magnetic field zone (example applied to the method disclosed in Japanese Unexamined Patent Application Publication No. 8-257692).

Casting conditions at that time were set as described below.

Direct current magnetic field application position (distance from molten metal level in mold to center of height of magnetic pole) A: 0.347 m Strength of applied magnetic field: 0.3 T Immersion nozzle
Upper hole: 2 holes, size of hole 12.2*12.2 mm
ejection angle θ=0° (horizontal)
Lower hole: single hole, size of hole 28 mm dia (circle)
ejection angle θ=90° (vertically downward)

Immersed depth of lower ejection hole (from molten metal level to lower end of lower ejection hole) 0.547 m Immersed depth of upper ejection hole (from molten metal level to center of upper ejection hole) 0.3 m Casting speed: 1.6 m/min (Throughput of cast 0.49 t/min)

Supply rate of molten steel from upper ejection hole Q':
Q
(equimultiple as consumption rate of molten steel that solidifies at a position above center of height of magnetic pole)

Distance from lower ejection hole to center of height of magnetic pole h: −0.2 m Distance from upper ejection hole to center of height of magnetic pole h': 0.047 m Conditions other than the above such as conditions under which Ni is added, and the like were set similar to those of Example 1.

Figure 14:
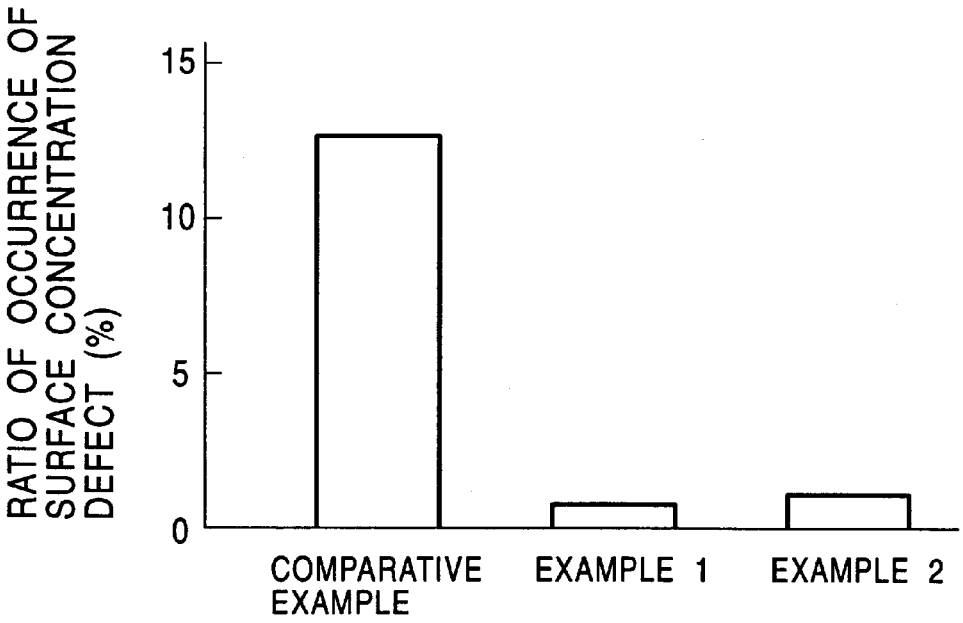
FIG. 14 is a chart showing the comparison of the ratios of occurrence of a Ni concentration defect in the surface layer of a cast piece in the example of the present invention and the comparative example.
Figure 15:
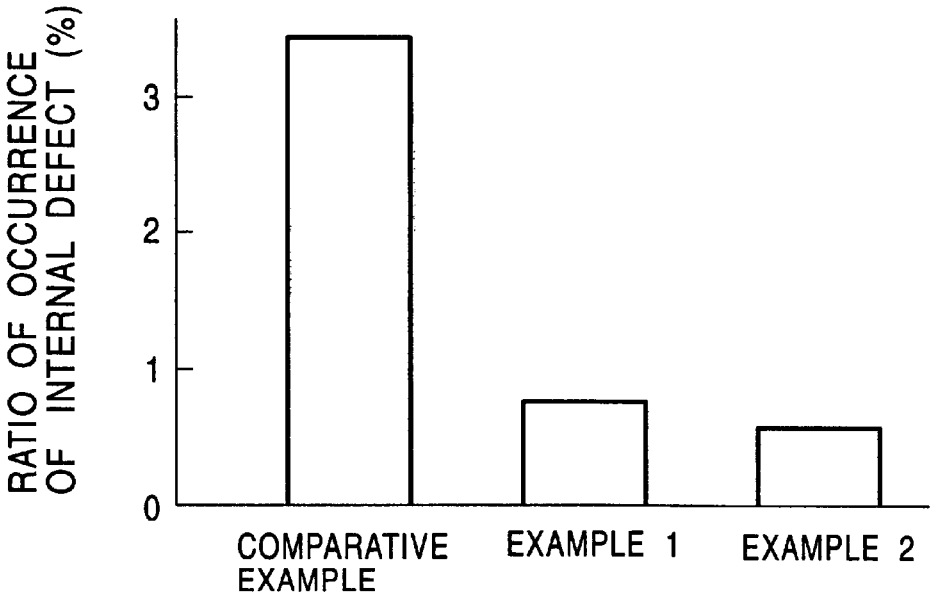
FIG. 15 is a chart showing the comparison of the ratios of occurrence of an internal defect of a cast piece in the example of the present invention and the comparative example.

The occurrence rate of faulty products were examined by comparing examples to which the present invention was applied with comparative examples. FIGS. 14 and 15 show results of the examination. It can be found that the concentration of the surface is less dispersed in the examples of the present invention as compared with the conventional examples and that the occurrence rate of faulty products greatly decreases.

Further, it can be also found that the occurrence rate of the inner defect of a cast slab which was caused by the mixture of inclusions reduces by half.

Example 3

Dimension of mold: long side 1.2 m, short side=0.26 m, height=0.9 m

Direct current magnetic field application position (distance from molten metal level in mold to center of height of magnetic pole) A: 0.60 m Height of magnetic pole: 0.2 m Strength of applied magnetic field: 0.3 T Immersion nozzle
nozzle inside diameter: 90 mm
upper hole: 2 holes,
size of hole 21*30
lower hole: 2 holes, size of hole 49 mm dia (circle)

Distance from lower ejection hole to center of height of magnetic pole h: 0.10 m Distance from upper ejection hole to center of height of magnetic pole h': 0.30 m (d=0.2 m)

Casting speed: 1.6 m/min

Throughput of cast: 3.5 t/min

Supply rate of molten steel from upper holes Q':
Q'=0.7 Q

Ni wire feed position (horizontal distance from upper ejection hole): 0.3 m

Ni wire melting positions (distances to the centers of upper ejection holes in height direction): 0.1–0.2 m Wire feed speed: 15 kg/min Continuous casting was performed by changing the angles of the nozzle ejection holes, and the influence thereof was examined.

Lower ejection holes: 2 holes,
ejection angle θ=0° (horizontal), 5°, 10°, 20°, 60° (downward)

Upper ejection holes: 2 holes,
ejection angle θ'=−10° (upward 10°), 0° (horizontal), 25°, 30°, 60° (downward)

Figure 16:
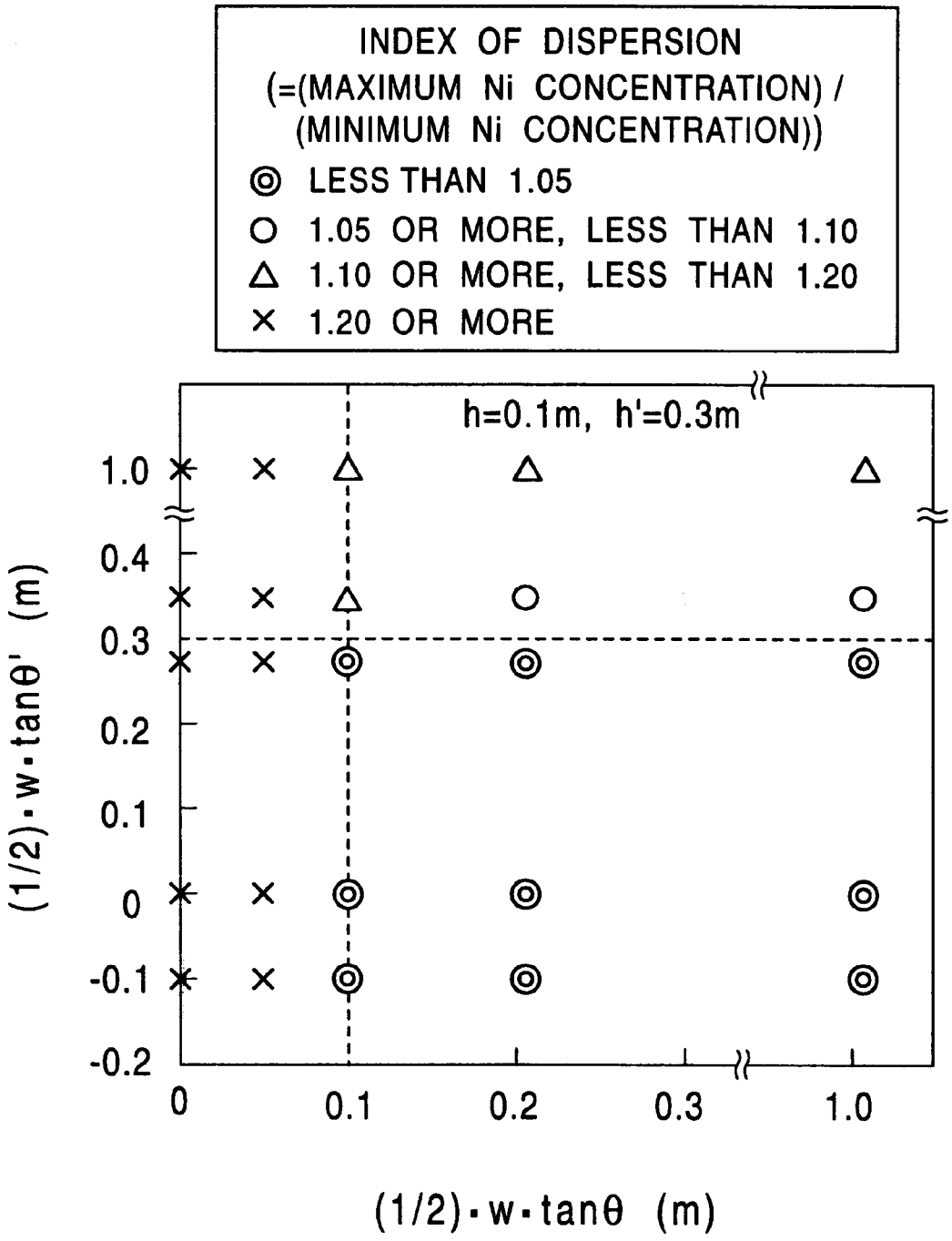
FIG. 16 is a chart showing the comparison of the dispersions of Ni concentration in the surface layer of a cast piece in the example of the present invention and the comparative example.

FIG. 16 shows an obtained result. In the figure, ◎ shows that the index of dispersion of Ni concentration in a surface layer (maximum Ni concentration/minimum Ni concentration) is less than 1.05; ○ shows that the index of dispersion is 1.05 or more and less than 1.10; Δ shows it is 1.10 or more and less than 1.20; and x shows it is 1.20 or more, respectively.

As apparent from the figure, it can be found that when the formula (1) shown above is satisfied, the dispersion of concentration of the solute is greatly reduced in the surface layer and that when the formula (2) shown above is satisfied, the dispersion is further more reduced.

Industrial Applicability

According to the present invention, not only the supply of molten steel to the upper and lower pools, in which the concentration of the solute element is different on both the sides of a boundary in the vicinity of the magnetic field zone, can be controlled very easily but also a cast slab, in which the dispersion of concentration of the solute element is very small in the surface layer portion of the cast slab, can be stably manufactured, whereby the yield of a product can be greatly improved. Further, since the molten steel is supplied only above the magnetic field section, no inclusion is entraped below the magnetic field section. Accordingly, an inner defect of the cast slab can be greatly reduced.

What is claimed is:

1. A method of manufacturing a continuously-cast slab by continuously casting molten steel in such a manner that a direct current magnetic field zone is applied to the cast slab over the entire width thereof in a direction across the thickness thereof at a position a predetermined distance below the molten metal level to casting direction in a continuously-casting mold and that the molten steel is poured using an immersion nozzle into a molten steel pool in or above the direct current magnetic field zone, the method comprising the steps of providing the immersion nozzle with ejection holes in at least upper and lower two stages; disposing at least one lower ejection hole such that it satisfies the following formula (1); setting the supply rate Q' of the molten steel supplied from upper ejection holes smaller than the rate Q consumed by solidification in the molten steel pool above the center of height of the direct current magnetic field zone; and adding a particular solute element to the molten steel in or above the direct current magnetic field zone, thereby adjusting the concentration of the solute element in the surface layer portion of the cast slab by increasing the concentration of the solute element as to the molten steel in the upper pool:

$$0<h<(1/2)\cdot w\cdot\tan\theta \quad (1)$$

where,

θ: downward angle of lower ejection hole(s) (°);

w: length of mold in width direction (m); and h: distance from center of lower ejection hole to center of height of magnetic pole (m).

2. A method of manufacturing a continuously-cast slab according to claim 1, wherein an immersion nozzle, which is designed such that the upper ejection holes satisfy the following formula (2), is used:

$$h'>(1/2)\cdot w\cdot\tan\theta' \quad (2)$$

where,

θ': downward angle of upper ejection holes (°);

w: length of mold in width direction (m); and h': distance from center of upper ejection hole to center of height of magnetic pole (m).

3. A method of manufacturing a continuously-cast slab according to claim 1, wherein an immersion nozzle, which is designed such that the upper ejection holes and the lower ejection hole(s) satisfy the following formulas (3) and (4), is used:

$$0<h\leqq 1.5V\cdot\sin\theta \quad (3)$$

$$d\leqq 0.5 \quad (4)$$

where, h: distance from center of lower ejection hole to center of height of magnetic pole (m);

V: average flow speed (m/s) of flow ejected from lower ejection hole(s) (m/s);

θ: downward angle of lower ejection hole(s) (°); and d: distance from center of upper ejection hole to center of lower ejection hole (m).

4. A method of manufacturing a continuously-cast slab according to claim 1, wherein an immersion nozzle, which is designed such that the supply rate of the molten steel from the upper ejection holes satisfies the following formula (5), is used:

$$0.3\cdot Q\leqq Q'\leqq 0.9\cdot Q \quad (5)$$

where,

Q':supply rate of molten steel from upper ejection holes (ton/min)

Q: consumption rate of molten steel which solidifies in molten steel pool above center of height of magnetic pole (ton/min).

* * * * *